US006536162B2

(12) United States Patent
LaMay

(10) Patent No.: US 6,536,162 B2
(45) Date of Patent: Mar. 25, 2003

(54) MOUNTING MECHANISM FOR SHUTTERS HAVING MOVABLE LOUVERS

(75) Inventor: Richard E. LaMay, West Lafayette, IN (US)

(73) Assignee: Lafayette Venetian Blind, Inc., West Lafayette, IN (US)

( * ) Notice: Subject to any disclaimer, the term of this patent is extended or adjusted under 35 U.S.C. 154(b) by 0 days.

(21) Appl. No.: 09/834,534

(22) Filed: Apr. 13, 2001

(65) Prior Publication Data

US 2002/0148165 A1 Oct. 17, 2002

(51) Int. Cl.[7] ..... E06B 7/08; B25G 3/00

(52) U.S. Cl. ..... 49/403; 49/74.1; 403/383

(58) Field of Search ..... 49/403, 74.1, 82.1, 49/92.1; 24/458, 356; 411/508, 510; 454/221, 224; 403/69, 70, 154, 161, 163, 300, 383, DIG. 10, 308, 331, 363, 381

(56) References Cited

U.S. PATENT DOCUMENTS

| | | | | | |
|---|---|---|---|---|---|
| 3,375,608 | A | * | 4/1968 | Thompson | 49/403 |
| 4,655,003 | A | | 4/1987 | Henley, Sr. | 49/88 |
| 4,834,163 | A | * | 5/1989 | Dickstein | 160/176.1 |
| 4,887,391 | A | | 12/1989 | Briggs, Sr. | 49/90 |
| 4,967,511 | A | * | 11/1990 | Werginz | 49/74.1 X |
| 4,974,362 | A | | 12/1990 | Briggs, Sr. | 49/90 |
| 5,052,150 | A | | 10/1991 | Chen | 49/84 |
| 5,216,837 | A | | 6/1993 | Cleaver et al. | 49/82.1 |
| 5,339,591 | A | | 8/1994 | Underdahl | 52/473 |
| 5,379,551 | A | | 1/1995 | Swapp | 49/82.1 |
| 5,392,561 | A | * | 2/1995 | Henley, Sr. | 49/74.1 |
| 5,469,658 | A | | 11/1995 | Digianni et al. | 49/82.1 |
| 5,630,295 | A | | 5/1997 | Neiman | 49/403 |
| 5,887,386 | A | | 3/1999 | Alexanian et al. | 49/403 |
| 6,094,864 | A | * | 8/2000 | Hsu | 49/82.1 |
| 6,263,632 | B1 | * | 7/2001 | Cadorette | 403/331 X |
| 6,305,892 | B1 | * | 10/2001 | Qiao | 411/508 |
| 6,314,680 | B1 | * | 11/2001 | Buckwalter et al. | 49/82.1 |

* cited by examiner

*Primary Examiner*—Daniel P. Stodola
*Assistant Examiner*—Hugh B. Thompson
(74) *Attorney, Agent, or Firm*—Woodard, Emhardt, Naughton, Moriarty & McNett LLP

(57) ABSTRACT

A shutter panel having a plurality of louvers having a composite construction. Each of the louvers is rotationally coupled to a shutter frame by a drive pin on one end and a support pin on the other end. The drive pins are linked to a rack and pinion louver mechanism for common rotational movement. In operation, the plurality of louvers rotate in unison by a simple manual action applied to a single louver. The drive pin includes a louver engaging end and a frame engaging end. The louver engaging end is a flat plate adapted to slip fit into a complementary slot included in a first end portion of the louver and retained therein by a complementary slot included in a first end portion of the louver and retained therein by interference forces. The slip fitting of the drive pin into the slot creates less stress on the louver and thus reduces the potential of crack initiation in the composite material of the louver.

23 Claims, 7 Drawing Sheets

MOUNTING MECHANISM FOR SHUTTERS HAVING MOVABLE LOUVERS

FIELD OF THE INVENTION

The present invention relates to a shutter assembly with movable louvers. More specifically, the present invention relates to a coupling mechanism for pivotal engagement of a louver to the frame of a shutter panel.

BACKGROUND OF THE INVENTION

Shutter panels employing movable or pivoting louvers for admitting a desirable amount of light and/or privacy are well-known in the art. Generally, a shutter panel has a rectangular frame which includes a frame opening. A plurality of louvers, all of which are typically identical, are disposed horizontally within the frame opening. The coupling of the louvers to the shutter frame is a common concern for the design of shutter assemblies having movable louvers. It is highly desirable to have a coupling mechanism that is operable for the life of the shutter, that provides good frictional drag characteristics, and that enables the louvers to smoothly and firmly rotate or pivot about an axis to a specific position and be maintained there.

Various coupling mechanisms attempting to achieve the above goal have been designed. Notably are those found in U.S. Pat. No. 4,655,003 issued to Henley, Sr., U.S. Pat. No. 4,887,391 issued to Briggs, Sr., U.S. Pat. No. 5,379,551 issued to Swapp, and U.S. Pat. No. 5,887,386 issued to Alexanian, et. al. These patents each disclosed a mounting pin for mounting the louver to the shutter frame. The mounting pin includes a cylindrical shaft portion adapted to engage the louver and a head portion adapted to rotatably engage the frame. When the louver is so coupled to the frame, as long as the louver is fixedly engage to the cylindrical shaft, a rotation of the louver would cause the head portion to rotate at its point of engagement to the shutter frame. Furthermore, the above systems also include mechanisms to control the rotation of the head portions within the shutter frame such that the positions of all of the louvers relative to the frame are maintained. Over time, the engagement of the cylindrical shaft with the louver may become worn from the periodic adjustments of the louvers. Once the contact between the cylindrical shaft and louver is loose, a cylindrical shaped shaft has no holding power over the louver, so the louver may rotate freely upon the cylindrical shaft. The position of the louver relative to the shutter frame can no longer be maintained.

U.S. Pat. No. 5,216,837 issued to Cleaver, et. al. discloses a mounting pin 20 having a bladed shaft, various views of which are shown in FIGS. 1–3. Mounting pin 20 includes a louver engaging end 21 and a frame engaging end 23 separated by a spacer 25. Louver engaging end 21 includes a cylindrical portion 26 having two rectangular blades 27 extending in opposing directions therefrom. Louver engaging end 21 is adapted for press fitting into a receiving slot (not shown) included in a louver and retained therein by interference forces. Pinion engaging end 23 includes a collar 28 which is adapted to rotatably engage the shutter frame. Similar to the above discussed disclosures, mounting pin 20 couples the louver to the frame by having louver engaging end 21 to engage the louver and frame engaging end 23 to rotatably engage the frame. With use, the receiver slot included in the louver may enlarged and lessen its grip on louver engaging end 21, at which time blades 27 would provide the hindrance preventing the louver from rotating freely. Hence, the inclusion of rectangular blades 27 at louver engaging end 21 provides a solution to the problem experienced by mounting pin designs having only cylindrical shafts.

Mounting pins 20 have been shown to perform satisfactorily with louvers made from wood but not with louvers made from some composite materials. Wood and fiber composites have been recognized as construction materials for louvers. These composites are low in material cost, and can be fashioned into louvers of different shapes besides straight planks that are readily made of wood. Additionally, louvers made from wood composites, after the application of a finish paint coat, are essentially indistinguishable in appearance from louvers made of wood. However, composites lack the structural integrity of wood. It has been shown that press fitting a mounting pin, like pin 20, into a composite louver is likely to initiate a crack at the point of insertion. This cracking causes aesthetic and structural concerns.

Accordingly, there is a need for a coupling mechanism for mounting composite louvers to a shutter frame without causing damage to the louvers.

SUMMARY OF THE INVENTION

The present invention provides a coupling mechanism that employs at least one drive pin for mounting a louver to a shutter frame. The drive pin includes a louver engaging end adapted to engage the louver and a gear engaging end adapted to engage the shutter frame. The louver engaging end includes a plate-like body that, in a preferred form, is characterized by having a partly arcuate perimeter and a face. The lower engaging end is designed to slip fit into a complementary slot included in the end of the louver and retains therein by friction. Because of the complementary fit, the drive pin does not exert pressing stress on the louver and therefore it is less prone to cause splitting or cracking damage to the louvers.

One object of the invention is to provide an improved mounting pin for mounting of louvers constructed of fiber composites to a shutter frame.

This and other objects of the present invention will be apparent from the following description of the preferred embodiments.

DESCRIPTION OF THE PREFERRED EMBODIMENTS

Figure 1:
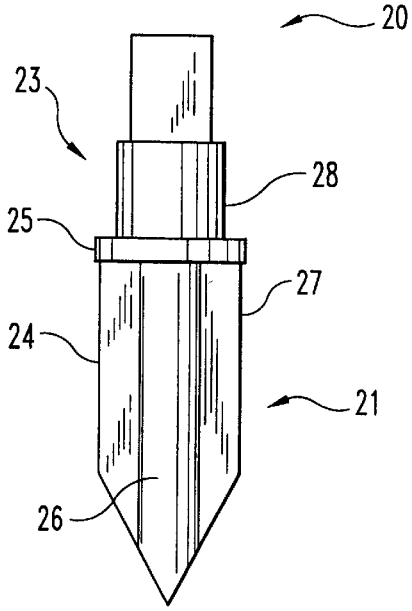
Fig. 1 (PRIOR ART)
FIG. 1 is a front elevational view of a prior art mounting pin for louvers.
Figure 2:
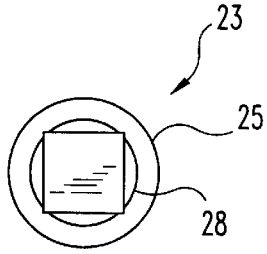
Fig. 2 (PRIOR ART)
FIG. 2 is a top plan view of the prior art louver mounting pin of FIG. 1.
Figure 3:
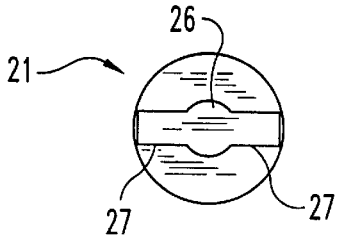
Fig. 3 (PRIOR ART)
FIG. 3 is a bottom plan view of the prior art louver mounting pin of FIG. 1.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates are also included.

Figure 4:
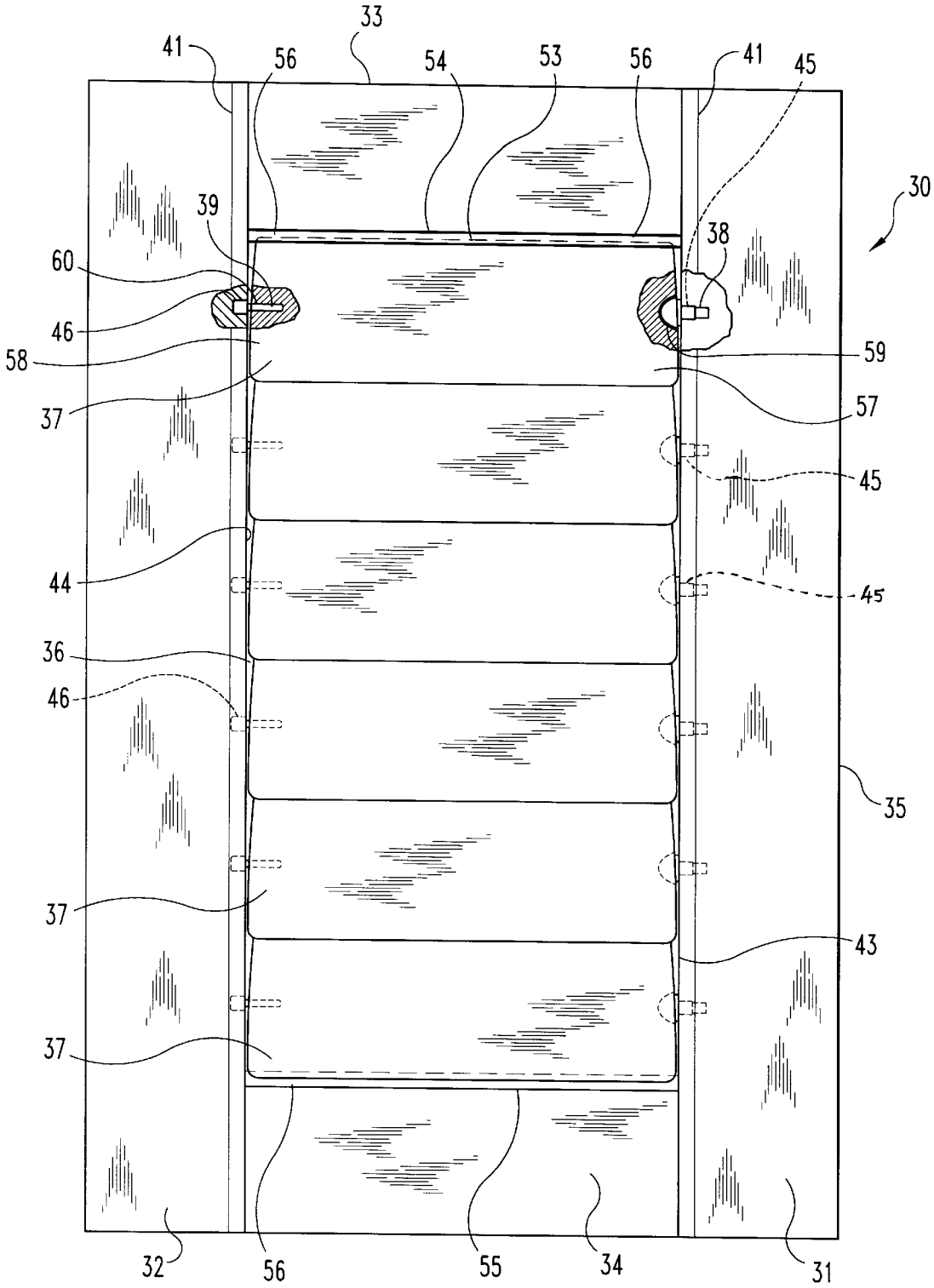
FIG. 4 is a front elevational view, in partial section, of an embodiment of a shutter panel showing the mounting pins of the present invention.

Referring to the drawings wherein like reference numerals designate corresponding components throughout the several views, there is shown in FIG. 4 an embodiment of a shutter panel 30 constructed in accordance with the present invention. Shutter panel 30 includes a substantially rectangular frame 35 and a plurality of louvers 37 each rotationally coupled to and supported within the frame opening 36 by a pair of mounting pins. The mounting pins include a drive pin 38 and a support pin 39. Drive pins 38 are preferably coupled to a louver mechanism 40 (FIG. 5) which enables the rotation of one louver 37 to cause like adjustment of the remaining louvers 37. Louver mechanism 40 has been described in detail in U.S. Pat. No. 5,216,837, the disclosure of which is expressly incorporated herein by reference in its entirety.

Shutter panel 30 is designed to be installed singularly or as one of a pair of shutter panels 30 over a window opening. In applications where shutter panel 30 is for placement adjacent to or in connection with like shutter panels 30, shutter panels 30 may be provided with an open face groove extending along the length of one side of frame 35, and a corresponding flange extending the length of an adjacent side of frame 35. At an installation site, the open groove of one shutter panel would overlap with the corresponding flange of an adjacent panel to avoid a gap thereinbetween. Other flange and groove configurations and connections known in art are also contemplated. In another embodiment, for example, shutter panel 30 might be hinged to an adjacent like shutter panel 30 to provide a folding window covering.

In the illustrated embodiment, shutter frame 35 is constructed of wood and includes a pair of vertically spaced stiles 31 and 32, respectively, and a pair of horizontal spaced rails 33 and 34, respectively, held together in a tongue-in-groove construction by a combination of adhesives and fasteners. Other materials and constructions known in the art are also contemplated. For example, shutter frame 35 can be constructed of aluminum or plastics and employ fasteners to connect its various components. In addition, shutter frame 35 may include decorative designs to enhance the aesthetic of shutter panel 30. In the illustrated embodiment, shutter frame 35 includes v-groove 41 engraved thereon.

Stiles 31 and 32 form the left and right sides, respectively, of shutter frame 35 and the length of which defines the length of shutter frame 35. Stiles 31 and 32 are elongated members having substantially rectangular cross-section and each having a peripheral edge or inner edge, 43 and 44, respectively, bordering the frame opening 36 of frame 35. Stiles 31 and 32 appear essentially identical viewing from the exterior of shutter panel 30. However, stile 31 is different in that it contains a hidden channel 47. While it is illustrated that stile 31 forms the right side of shutter frame 35, stile 31 may form the left side or both sides of the shutter frame 35 without deviating from the scope of the present invention.

Inner edges 43 and 44 include a series of vertically spaced mounting apertures 45 and 46, respectively, disposed therein. The series of mounting apertures 45 and 46 are horizontally aligned with one another with respect to shutter frame 35. The number of paired apertures 45 and 46 matches the number of louvers 37 to be mounted within shutter opening 36. The vertical distance between adjacent mounting aperture 45 and 46 is less than the width of louver 37, such that, when assembled, adjacent louvers 37 will overlap when they are rotated to the vertical, closed position. The mounting apertures 45 and 46 are sized to rotatably received mounting pins 38 and 39, respectively, and contain a tolerance which allows easy rotation while maintaining a feeling of control.

Figure 5:
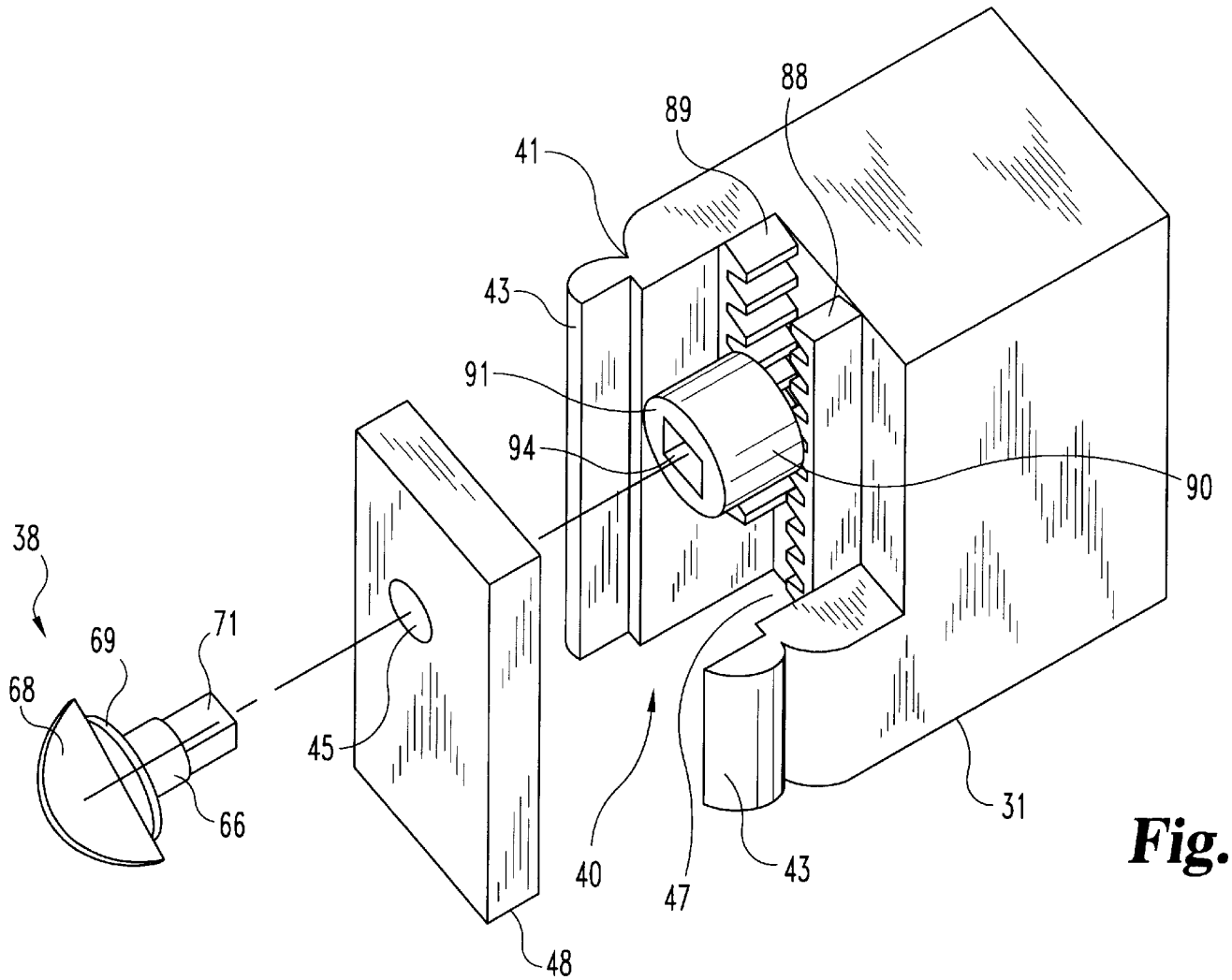
FIG. 5 is an exploded view, in perspective, of an embodiment of a louver mechanism included in the shutter panel of FIG. 4.

As shown in FIG. 5, channel 47 is provided for housing a louver mechanism 40. Preferably, the dimension of channel 47 is barely adequate to accommodate louver mechanism 40, such that louver mechanism 40 cannot shift around after it is installed. Channel 47 is cored into stile 31 from inner edge 43. Preferably, channel 47 is rectangular and extends the entire length of stile 31. A cover plate 48 is provided to fit over channel 47. Cover plate 48 is of such thickness that when installed over channel 47 it lies flush with the uncut portion of inner edge 43 and forms part of inner edge 43 of stile 31. The mounting apertures 45 described above are included through cover plate 48. Towards the back wall 50 of channel 47, a series of vertical space holes 51 (FIG. 12) which are in alignment with mounting apertures 45 are provided. Holes 51 are configured to receive the post portions 93 of the pinion gears 90 of louver mechanism 40.

While a cored channel 47 is described in this illustrated embodiment for housing the louver mechanism 40, other housing arrangements, in which the housing is a separate component received in the stile, are also contemplated. For example, the housing could be a rectangular U-shaped aluminum channel received in the stiles. The choice of housing may vary according to the particular application, wherein shutter panels employed in harsh environments and subjected to water damage are likely to include a separate housing to resist warping. Conversely, indoor applications having a controlled environment are likely to employ the rectangular channel 47 that is machined in stile 31 as describe above and in FIG. 5.

Referring back to FIG. 4, rails 33 and 34 fit between the two vertical stiles 31 and 32 and form the top and bottom of shutter frame 35. In this illustrated embodiment, for aesthetic reasons, rails 33 and 34 are slightly thinner than stiles 31 and 32. Rail 33 and 34 include inner peripheral edges or inner edges, 54 and 55, respectively, bordering frame opening 36. Two ribs 56 are defined approximately at the center of, and extending along inner edges 54 and 55. Ribs 56 protrude into frame opening 36 and are of a sufficient height and thickness capable of stopping the adjacent louvers 37 from further rotation when being engaged. In this embodiment, ribs 56 are formed integrally on rails 34 and 35. However, ribs 56 may be formed by fixedly securing an additional piece of wood or other rigid material to rails 33 and 34.

As shown in FIG. 4, a plurality of elongated louvers 37 is disposed horizontally within frame opening 36. The louvers 37 are typically identical and extend between the inner peripheral edges 43 and 44 of stiles 31 and 32, respectively. Each louver 37 includes a first end 57 and an opposing second end 58. A slot 59, recessed approximately at the center of first end 57, is configured for receiving drive pin 38. In this illustrated example, slot 59 forms a segment of a circle having a diameter of approximately one inch. Slot 59 is formed by routing with a spinning disc cutter. However, other methods of creating a semi-circular recess can be used, and those methods are within the knowledge of those skilled in the art. A bore hole 60, recessed approximately at the center of second end 58, is configured for receiving support pin 39. In this illustrated example, bore hole 60 is formed by drilling and is approximately 0.125 inches in diameter.

In the illustrated embodiment, louvers 37 are made of a fiber composite. Fiber composites offer the advantage of low material cost and the ease of forming louvers into shapes other than straight planks. A seal coat, preferably vinyl, may be applied after shaping the louver. While a fiber composite louver 37 is illustrated, louvers made of other construction materials, e.g. other composite materials or wood, can also be used with the present invention.

Figure 7:
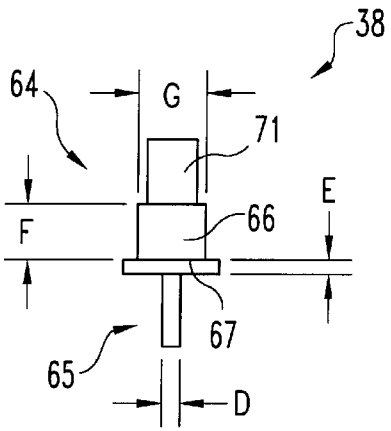
FIG. 7 is a side elevational view of the drive pin of FIG. 6.
Figure 8:
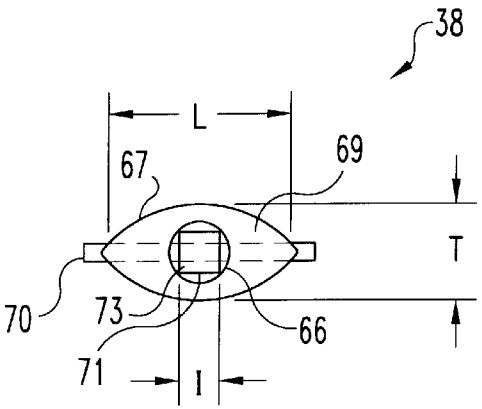
FIG. 8 is a top plan view of the drive pin of FIG. 6.
Figure 6:
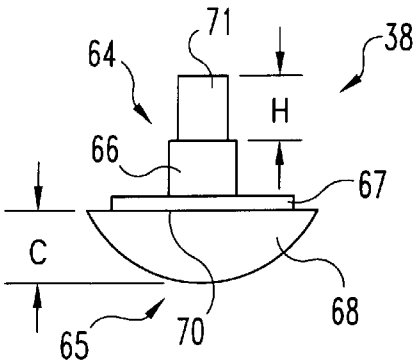
FIG. 6 is a front elevational view of an embodiment of a drive pin included in the shutter panel of FIG. 4.

A pair of mounting pins which includes a drive pin 38 and a support pin 39 is provided to couple each of the plurality of louvers 37 to shutter frame 35. FIGS. 6–8 show an embodiment of a drive pin 38 of the present invention. Drive pin 39 is of a single-piece construction and includes a frame engaging end 64 and a louver engaging end 65 separated by a separator 67. Louver engaging end 65 includes a flat plate-like body having a partly arcuate perimeter and a face 68. In this specific embodiment, face 68 forms a segment of a circle having a diameter of approximately one inch. The straight edge 70 of the segment measures approximately 0.9 inch and the width C of face 68 measures approximately 0.285 inches. Furthermore, the thickness D of the flat plate-like body of louver engaging end 65 measures approximately 0.09 inch.

Separator 67 is a thin plate having an oval face 69 which defines a major axis L and a minor axis T. Oval face 69 is oriented orthogonal to face 68 of louver engaging end 65 and major axis L is parallel to straight edge 70. In this specific embodiment, the length of major axis L is approximately 0.72 inch and the length of the minor axis T is approximately 0.375 inches. Furthermore, the thickness E of separator 67 is approximately 0.05 inches.

Frame engaging end 64 includes a collar 66 and a gear portion 71. Collar 66 extends from separator 67 of drive pin 38 and gear portion 71 extends from collar 66. Collar 66 is cylindrical and is configured to rotatably engage mounting aperture 45 and to extend gear portion 71 to reach louver mechanism 40. Preferably, the diameter G is sufficiently similar to the diameter of mounting apertures 45, such that collar 66 can rotate within mounting aperture 45 with ease and control. In addition, the length F of collar 66 is sufficient long to allow gear portion 71 to firmly engage louver mechanism 40. Preferably, length F of collar 66 is approximately the same as the thickness of cover plate 48. In this specific embodiment, diameter G is approximately 0.25 inches and length F is approximately 0.2 inches. Gear portion 71 is configured to engage louver mechanism 40 through mounting aperture 45. Gear portion 71 is rectangular, defining a longitudinal length H and a cross sectional face 73. In this specific embodiment, face 73 is square and the length I of its sides measures approximately 0.185 inch and length H is approximately 0.26 inch.

Figure 9:
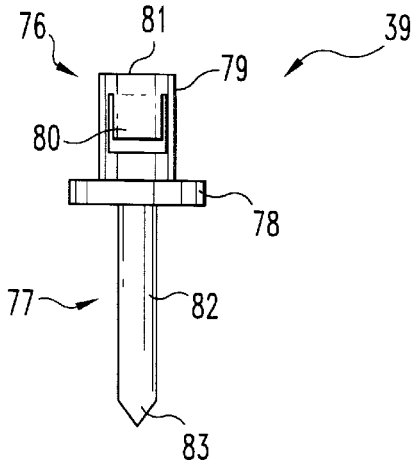
FIG. 9 is a front elevational view of a support pin included in the shutter panel of FIG. 4.
Figure 10:
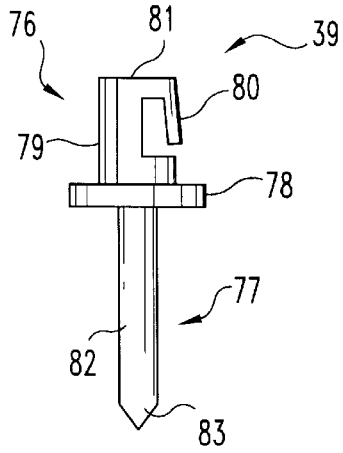
FIG. 10 is a side elevation view of the support pin of FIG. 9.
Figure 11:
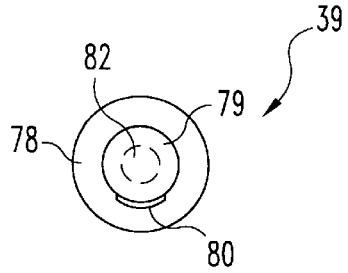
FIG. 11 is a top plan view of the support pin of FIG. 9.

FIGS. 9–11 show an embodiment of a support pin 39 of the present invention. Support pin 39 is of one-piece construction and includes a cylindrical stile engaging end 76 and an opposing louver insertion end 77 separated by a cylindrical spacer 78. Stile engaging end 76 is configured to rotatably engage mounting aperture 46 of stile 32. Stile engaging end 76 has a partially cylindrical body 79 having a spring flap 80 integrally formed thereon. Spring flap 80 is hinged at top 81 of cylindrical body 79. In its natural state, spring flap 80 springs outward and away from cylindrical body 79, but can be compressed to remain close to cylindrical body 79. Louver insertion end 77 is configured to insert and be retained in bore hole 60 included in second end 58 of louver 37. Louver insertion end 77 is pin shaped having a cylindrical shaft 82 and a conical tip 83. In this illustrated embodiment, the overall length of louver insertion end 77 is approximately 0.69 inches and the diameter of the cylindrical shaft 82 is approximately 0.134 inches.

To ensure quiet and maintenance-free operation, drive pin 38 and support pin 39 are constructed of a sturdy, ductile lubricious plastic. Nylon has been found to provide good frictional drag characteristics a smooth, but firm feel, and without tending to bind. Preferably, drive pin 38 and support pin 39 are constructed of nylon. However, other materials which have the wear strength and drag characteristics may also be used.

Figure 12:
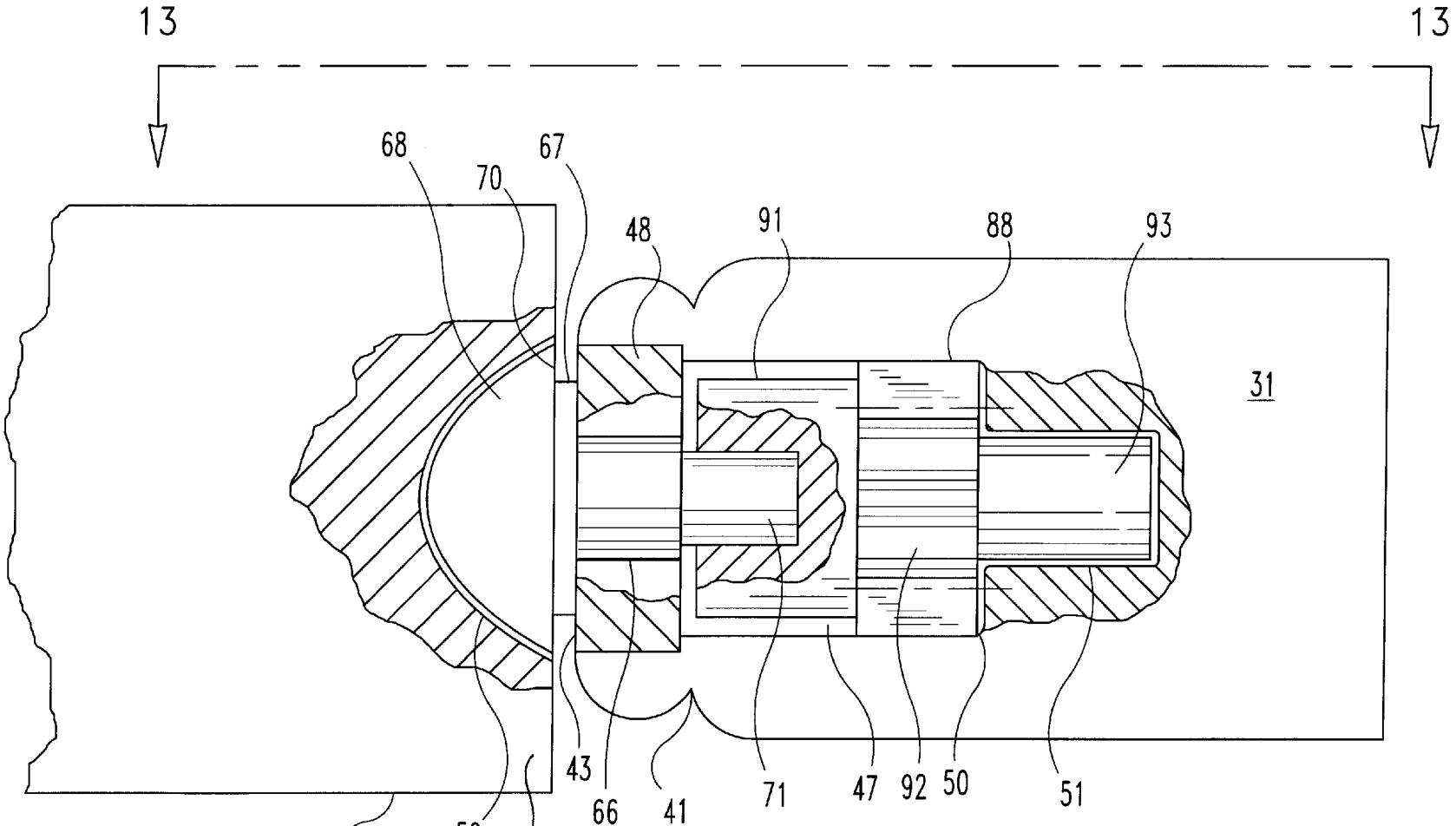
FIG. 12 is a top plan view, in partial section, showing a portion of the shutter panel of FIG. 4 and illustrating the engagement of the drive pin of FIG. 6 to the louver mechanism of FIG. 5 and to the louver.
Figure 13:
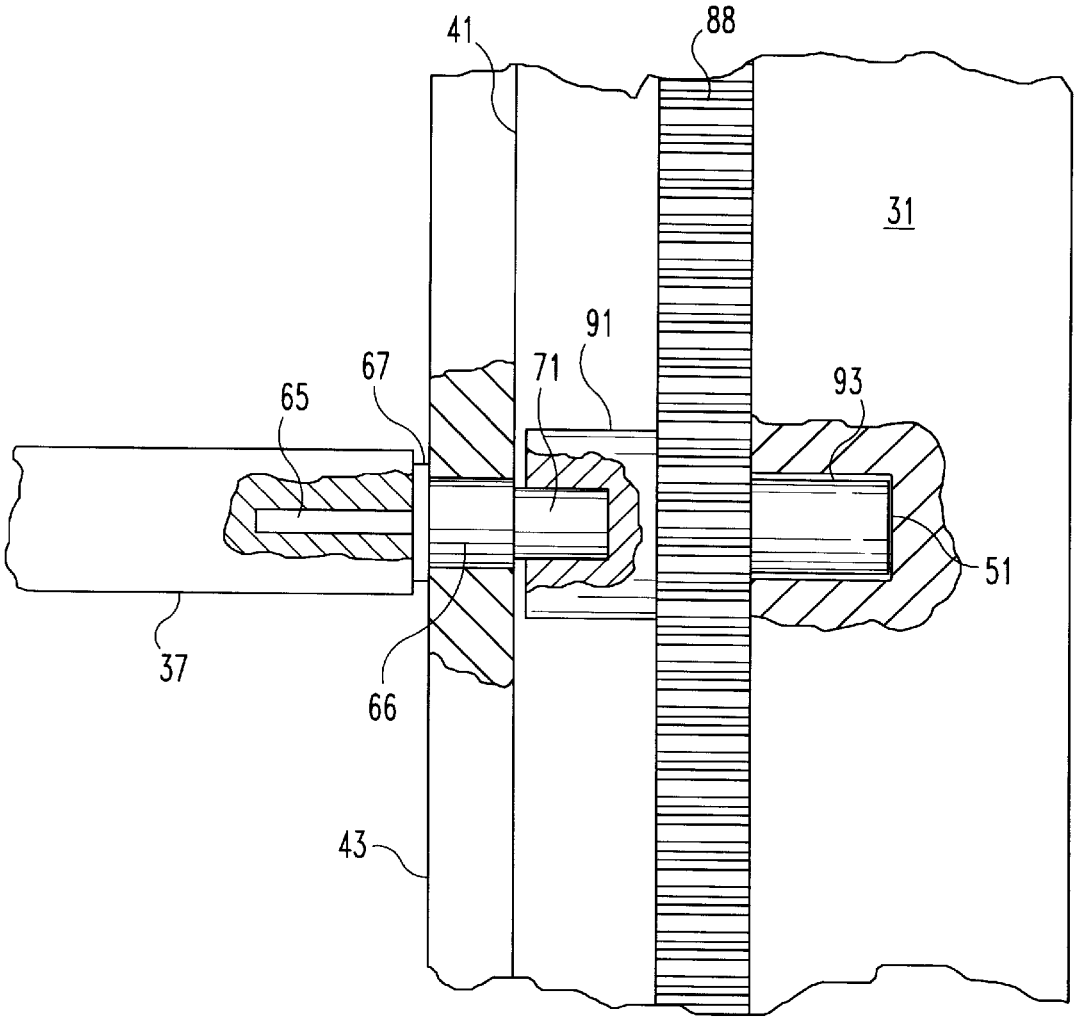
FIG. 13 is a side elevation view, in partial section, of the shutter panel of FIG. 12 taken along line 13—13 in FIG. 12.

FIGS. 5, 12 and 13 show an embodiment of the louver mechanism 40 which is used in conjunction with drive pin 38 of the present invention. Louver mechanism 40 is a rack and pinion gear mechanism including first and second longitudinal gear racks 88 and 89, respectively, and a plurality of pinion gears 90. The plurality of pinion gears 90 corresponds to that of movable louvers 37 in shutter panel 30. Pinion gear 90 includes a head portion 91, a gear portion 92 and a post portion 93. Head portion 91 includes a pin recess 94 which.is configured to receive gear portion 71 of frame engaging end 64 of drive pin 38. Gear portion 92 contains gear teeth (not shown) configured to mesh with both longitudinal gear racks 88 and 89. Post portion 93 is cylindrical and is configured to rotatably engage hole 51 included on back wall 50 of channel 47 in stile 31. The various components of the louver mechanism 40 are constructed of plastic, preferably of nylon plastic.

Generally, one louver mechanism 40 is included per shutter panel 30. However, in some special applications, e.g. shutter panel 30 which includes longer louvers, a second louver mechanism 40 may be included. In such application, a second cored stile 31 is incorporated into frame 35 for housing the second louver mechanism 40.

Shutter panel 30 is easily assembled. Preferably, louver mechanism 40 is first assembled. As shown in FIGS. 5, 12 and 13, louver mechanism 40 is completely contained within channel 47 of stile 31. Racks 88 and 89 having pinion gears 90 engaged thereinbetween fit snugly between the side walls of channel 47. Pinion gears 90 are spaced apart in alignment with holes 51 and into which post portions 93 of pinion gears 90 are rotatably received. So placed, the teeth of gear portion 92 mesh with racks 88 and 89 such that rotation of one pinion gear 90 causes longitudinal racks 88 and 89 to translate in opposite directions within channel 47. Additionally, because of the limited depth of channel 47, pinion gear 90 cannot jump out of engagement with racks 88 and 89 once cover plate 48 is put in place. Generally, louver mechanism 40 is hidden from view and is actuated by drive pins 38 through mounting apertures 45. During installation of cover plate 48, special care is taken to ensure that mounting apertures 45 on cover plate 48 are aligned with pin receivers 94. To engage pinion gears 90, the frame engaging ends 64 of drive pins 38 are inserted through mounting apertures 45 until separators 67 contact inner edge 43 of stile 31. While the collars 66 rotatably engage mounting apertures 45, gear portions 71 extend past cover plate 48 and are received in pin recesses 94. Drive pins 38 thus are coupled to louver mechanism 40 such that the rotation of a drive pin 38 rotates the associated pinion gear 90 which in turn actuates louver mechanism 40 for the rotation of the rest of the pinion gears included thereon.

The first end 57 of each of the plurality of louvers 37 is first coupled to shutter frame 35. Slot 59 at first end 57 of louver 37 is slip-fitted over the louver engaging end 65 of drive pin 38. The snug fit between slot 59 and louver engaging end 65 enables louver engaging end 65 to stay in slot 59 by friction, making the common practice of using adhesive to fixedly engaging slot 59 to louver engaging end 65 not essential. Furthermore, half-moon face 68 of louver engaging end 65 prevents louver 37 from rotating freely and is also capable of exerting rotational torque to louver 37 even when slot 59 is only loosely fitted over louver engaging end 65. However, adhesive may be applied if preferred. It should be understood that slip fit has a distinct advantage over the press fit of most prior art mounting pin designs. Compression stress resulting from press fitting of a mounting pin to a louver is the likely cause of cracking, especially in louvers made from composite materials. Slip fitting generally does not induce compression stress and therefore lessen the probability of initiating a crack in louvers 37. Additionally, the incorporation of separator 67 to the design of drive pin 38 also lessens the chance of damaging louver 37 from the over insertion. Separator 67 serves as a stop to prevent drive pin 38 from being pushed too deeply into slot 59.

The second end 58 of each of the plurality of louver 37 is coupled to shutter frame 35 by support pin 39. Louver insertion end 77 of support pin 39 is inserted into bore hole 60 until spacer 78 engages second end 58 of louver 37. Because of the close tolerance between louver insertion end 77 and bore hole 60, louver insertion end 77 simply slips inside bore hole 60 and retainer therein by interference fit. However, because the rotation of louver 37 is controlled by drive pin 38, it is of no consequence if louver 37 does not retain a grip on louver insertion end 77. The common practice of using adhesive to fixedly attach louver 37 onto the louver insertion end 77 is therefore not essential, but can be applied if preferred. Additionally, as louver insertion end 77 is being inserted, spacer 78 serves as a stop to prevent louver insertion end 77 from being pushed too deeply into bore hole 60, thus avoiding the damage which might result from such inadvertent action.

After louver insertion ends 77 of support pins 39 are installed in bore holes 60, the stile engaging ends 76 of support pins are rotatably received in mounting aperture 46 included in stile 32. Stile engaging end 76 may be inserted until spacer 78 contacts inner edge 44 of stile 32. Spring flap 80 of louver insertion end 77 is pressed closed to cylindrical body 79 to ease the insertion of cylindrical body 79 into mounting aperture 46. After insertion, spring flap 80 spring regains its natural open position and presses against the surrounding wall of mounting aperture 46 thus discouraging stile engaging end 76 from slipping out. Due to the complementary dimension between mounting aperture 46 and stile engaging end 76, stile engaging end 76 rotates within mounting aperture 46 with ease while maintaining a feel of control.

After the plurality of louvers are installed on the stiles 31 and 32 as described above, stiles 31 and 32 and rails 33 and 34 are joined together according to traditional woodworking techniques to fixedly retained the plurality of louvers 37 within frame opening 36. Separator 67 and spacer 78 serve as spacers interposing between inner periphery edges 43, 44 and first and second ends 57, 58, respectively, of louver 37 and guarantee a minimum clearance to allow unhindered rotation of louver 37. In addition, oval face 69 covers slot 59 and spacer 78 covers bore hole 60, thus impart a pleasing finished appearance to shutter panel 30.

In operation, the plurality of louvers 37 may be rotated on their mounting pins 38 and 39 by a simple manual action applied to a single louver 37 by a user. The louvers 37 may be continuously adjusted between an open position, in which adjacent louvers 37 are vertically spaced apart, and a closed position, in which adjacent louvers 37 are vertically overlapping, until the louvers 37 which are adjacent to either rail 33 or 34 engages rib 56. The range of rotation is thus limited to approximately 180 degrees. Once the louvers 37 are moved to a selected position, racks 88 and 89 and pinion gear 90 of louver mechanism 40 frictionally maintain the preferred position without additional stress on louvers 37.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A shutter panel, comprising:

a frame, a plurality of louvers; and a coupling mechanism for supporting a louver to a frame, said coupling mechanism comprising two mounting pins, at least one of said two mounting pins is a drive pin, said drive pin includes a frame engaging end and a louver engaging end, said louver engaging end having a planar body which is adapted to engage slid louver and permit rotation of said drive pin with said louver and said frame engaging end is adapted to engage said frame and is thereby capable of coupling said louver to said frame, wherein said frame engaging end of said drive pin includes a collar portion and a gear portion, with said collar portion adapted to engage said frame and said gear portion adapted to engage a louver mechanism, wherein said drive pin further includes a separator interposing between said louver engaging end and said frame engaging end, and wherein said planar body includes a partly arcuate perimeter extending orthogonally to said separator.

2. The shutter panel of claim 1, wherein said frame engaging end of said drive pin includes a collar portion and a gear portion, with said collar portion adapted to engage said frame and said gear portion adapted to engage a louver mechanism.

3. The shutter panel of claim 2, wherein said drive pin is of a single piece construction and said separator has an oval face.

4. The shutter panel of claim 3 wherein said drive pin is constructed of nylon plastic.

5. The shutter panel of claim 4, wherein said planar body includes a partly arcuate perimeter and a face.

6. The shutter panel of claim 5, wherein said face of said louver engaging end forms a segment of a circle having a diameter of approximately one inch and said planar body is approximately 0.09 inch thick.

7. The shutter panel of claim 6, wherein said face includes a straight edge and a width, said straight edge is approximately 0.9 inch and said width is approximately 0.285 inch.

8. The shutter panel of claim 5, wherein one of said two mounting pins is a support pin, said support pin includes a louver insertion end and a stile engaging end having a spacer interposed thereinbetween, said louver insertion end includes a pin-shaped body having a cylindrical shaft and a conical tip and is adapted to engage said louver, and said stile engaging end includes a cylindrical body adapted to rotatably engage said frame.

9. The shutter panel of claim 8, wherein said cylindrical body of said stile engaging end of said support pin includes a spring flap integrally formed thereon, and said spring flap presses against a mounting aperture after insertion therein thereby discouraging said cylindrical body from slipping out of said mounting aperture.

10. The shutter panel of claim 9, wherein said support pin is constructed of nylon plastic.

11. A shutter panel, comprising:

a frame, a plurality of louvers;

a couple of mounting pins for each said plurality of louvers, at least one of said couple of mounting pins is a drive pin, said drive pin including a frame engaging end and a louver engaging end, said louver engaging end includes a planar body, wherein said planar body engages said louver, and said frame engaging end engages said frame and thereby coupling said louver to said frame, wherein said frame engaging end of said drive pin includes a collar portion and a gear portion, with said collar portion adapted to engage said frame and said gear portion adapted to engage a louver mechanism, wherein said drive pin further includes a separator interposing between said louver engaging end and said frame engaging end, and wherein said planar body includes a partly arcuate perimeter extending orthogonally to said separator.

12. The shutter panel of claim 11, wherein said drive pin is of a one piece construction.

13. The shutter panel of claim 12, wherein said face of said drive pin forms a segment of a circle having a diameter of approximately one inch, and said plate-like body is approximately 0.09 inch thick.

14. The shutter panel of claim 13, wherein said couple of mounting pins includes a support pin, said support pin is of a one piece construction having a louver insertion end and a stile engaging end, said louver insertion end includes a cylindrical body having a conical tip and is adapted to engage said louver, and said stile engaging end has a cylindrical body and is adapted to rotatably engage said frame.

15. The shutter panel of claim 14, wherein said cylindrical body of said stile engaging end of said support pin further includes a spring flap integrally formed thereon, said spring flap presses against said frame when said stile engaging end is received in said frame thereby discouraging said stile engaging end from slipping out.

16. The shutter panel of claim 15, wherein said drive pin and said support pins are constructed of nylon plastics.

17. The shutter panel of claim 16, wherein said plurality of louvers are constructed of a fiber composite.

18. The shutter panel of claim 17, wherein said louver mechanism comprises means to receive said gear portions of said drive pins thereby enabling said plurality of louvers to rotate in unison when one of said louvers is rotated.

19. The shutter panel of claim 18, wherein said louver mechanism is housed within a channel of said stile and is generally hidden from view.

20. A louvered shutter comprising:

a frame, said frame having first and second vertical side stiles and top and bottom horizontal rails which together defining, a frame opening, each of said first and second side stiles having a plurality of vertically spaced mounting apertures included therein, said plurality of mounting apertures of said first stiles aligns horizontally with said plurality of apertures of said second side stile and with respect to said frame opening;

a plurality of louvers, each said louvers includes opposing first and second end portions, said first end portion having a slot centrally disposed therein and said second end portion having a bore hole centrally disclosed therein;

a plurality of drive pins corresponding to said plurality of louvers, each said drive pin includes a louver engaging end and a frame engaging end and a separator interposing between said louver engaging end and said frame engaging end, said louver engaging end having a body which includes a partly arcuate perimeter extending orthogonally to said separator and a face, said face forms a segment of a circle and is adapted to slip fit in said slot included in said first end portion of said louver, said frame engaging end having a collar and a gear portion extending from said collar, said collar is adapted to rotatably engaging said mounting apertures disposed on said first side stile;

a plurality of support pins corresponding to said plurality of louvers, each said support pin includes a louver insertion end and a stile engaging end;

wherein said louver engaging end of said drive pin is received in said slot included in said first end portion of said louver, said frame engaging end is received in said mounting aperture of said first side stiles, and wherein said louver insertion end of said support pin is received in said bore hole included in said second end portion of said louver, said stile engaging end is received in corresponding said mounting apertures of said second side stile, thereby coupling said louver to said frame.

21. The louver shutter of claim 20 further including a louver mechanism, said louver mechanism includes means to engage said drive pins thereby connecting said plurality of louvers to said louver mechanism.

22. The louver shutter of claim 21, wherein said stile engaging end includes a cylindrical body having a spring flap formed thereon, said spring flap presses against said mounting aperture when received therein thereby discouraging said support pin from slipping out of said mounting aperture.

23. The louver shutter of claim 22, wherein said horizontal rails further include ribs extended along said rails, said ribs are adapted to limit said louver from rotating more than 180 degree.

* * * * *